US005282905A

United States Patent [19]

Reichgott et al.

[11] Patent Number: 5,282,905

[45] Date of Patent: * Feb. 1, 1994

[54] METHOD AND COMPOSITION FOR TREATMENT OF GALVANIZED STEEL

[75] Inventors: David W. Reichgott, Richboro; Fu Chen, Newtown, both of Pa.

[73] Assignee: Betz Laboratories, Inc., Trevose, Pa.

[ * ] Notice: The portion of the term of this patent subsequent to Oct. 27, 2009 has been disclaimed.

[21] Appl. No.: 907,428

[22] Filed: Jul. 1, 1992

Related U.S. Application Data

[63] Continuation-in-part of Ser. No. 654,159, Feb. 12, 1991, Pat. No. 5,158,622.

[51] Int. Cl.[5] ..... C23C 22/34

[52] U.S. Cl. ..... 148/247; 148/251

[58] Field of Search ..... 148/247, 251

[56] References Cited

U.S. PATENT DOCUMENTS

| | | | |
|---|---|---|---|
| 3,468,724 | 9/1969 | Reinhold | 148/6.15 |
| 3,682,713 | 8/1972 | Ries et al. | 148/6.14 R |
| 4,136,073 | 1/1979 | Muro et al. | 260/29.2 |
| B1 4,191,596 | 6/1990 | Dollman et al. | 148/247 |
| 4,273,592 | 6/1981 | Kelly | 148/6.27 |
| 4,294,627 | 10/1981 | Heyes | 148/6.14 R |
| 4,370,177 | 1/1983 | Frelin et al. | 148/6.27 |
| 4,422,886 | 12/1983 | Das et al. | 148/31.5 |
| 4,471,100 | 9/1984 | Tsubakimoto et al. | 525/367 |
| 4,500,693 | 2/1985 | Takehara et al. | 526/240 |
| 4,709,091 | 11/1987 | Fukumoto et al. | 562/595 |
| 4,847,410 | 7/1989 | Lickei et al. | 562/583 |
| 4,861,429 | 8/1989 | Barnett et al. | 162/199 |
| 4,872,995 | 10/1989 | Chen et al. | 210/699 |
| 4,895,622 | 1/1990 | Barnett et al. | 162/199 |
| 4,913,822 | 4/1990 | Chen et al. | 210/699 |
| 4,921,552 | 5/1990 | Sander et al. | 14.8/247 |
| 4,929,362 | 5/1990 | Chen | 210/701 |
| 4,959,156 | 9/1990 | Lickei et al. | 210/701 |
| 5,158,622 | 10/1992 | Reichgott | 148/247 |

FOREIGN PATENT DOCUMENTS

| | | |
|---|---|---|
| 56-155692 | 12/1981 | Japan . |
| WO8505131 | 11/1985 | PCT Int'l Appl. . |

OTHER PUBLICATIONS

Chem.Abstract 11:10119V, 1989.

*Primary Examiner*—Sam Silverberg

*Attorney, Agent, or Firm*—Alexander D. Ricci; Steven D. Boyd

[57] ABSTRACT

Methods of forming a conversion coating on metal surfaces such as galvanized steel are provided. The methods comprise reacting the metal surface with an aqueous solution of a water soluble polyacrylic acid or homopolymer thereof, maleic or acrylic acid/allyl ether copolymer alone or with an acid.

16 Claims, No Drawings

METHOD AND COMPOSITION FOR TREATMENT OF GALVANIZED STEEL

This application is a continuation-in-part of application Ser. No. 07/654,159 filed Feb. 12, 1991 now U.S. Pat. No. 5,158,622.

FIELD OF THE INVENTION

The present invention relates generally to non-chromate coatings for metals. More particularly, the present invention relates to a non-chromate coating for galvanized steel which improves the corrosion resistance and adhesion of paints to the surface. The present invention provides a dried in place coating which is particularly effective at treating galvanized steel coil strip.

BACKGROUND OF THE INVENTION

The purposes of the formation of a chromate conversion coating on the surface of galvanized steel are to provide corrosion resistance, improve adhesion of coatings and for aesthetic reasons. The conversion coating improves adhesion of coating layers such as paints, inks, lacquers and plastic coatings. A chromate conversion coating is typically provided by contacting galvanized steel with an aqueous composition containing hexavalent or trivalent chromium ions, phosphate ions and fluoride ions. Growing concerns exist regarding the pollution effects of the chromates and phosphates discharged into rivers and waterways by such processes. Because of high solubility and the strongly oxidizing character of hexavalent chromium ions, conventional chromate conversion processes require extensive waste treatment procedures to control their discharge. In addition, the disposal of the solid sludge from such waste treatment procedures is a significant problem.

Attempts have been made to produce an acceptable chromate free conversion coating for galvanized steel. Chromate free pretreatment coatings based upon complex fluoacids and salts or metals such as cobalt and nickel are known in the art. U.S. Pat. No. 3,468,724 which issued to Reinhold discloses a composition for coating ferriferous and zinc metal which comprises a metal such as nickel or cobalt and an acid anion selected from the group sulfate, chloride, sulfamate, citrate, lactate, acetate, and glycolate at a pH from 0.1 to 4.

PCT Publication No. WO 85/05131 discloses an acidic aqueous solution to be applied to galvanized metals which contains from 0.1 to 10 grams per liter of a fluoride containing compound and from 0.015 to 6 grams per liter of a salt of cobalt, copper, iron, magnesium, nickel, strontium or zinc. Optionally, a sequestrant and a polymer of methacrylic acid or esters thereof can be present.

The formation of chromate free conversion coatings on the surfaces of other metals such as aluminum are also known. U.S. Pat. No. 4,921,552 which issued to Sander et al., discloses a non-chromate coating for aluminum which is dried in place and which forms a coating having a gravimetric weight from about 6 to 25 milligrams per square foot. The aqueous coating composition consists essentially of more than 8 grams per liter dihydrohexafluozirconic acid, and more than 10 grams per liter of water soluble acrylic acid and homopolymers thereof and more than 0.17 grams per liter hydrofluoric acid. The disclosure notes that it is believed that the copolymers of acrylic acid would also be effective, however, no examples were given. U.S. Pat. No. 4,191,596 to Dollman et al., discloses a conversion coating for aluminum which consists essentially of from about 0.5 to 10 grams per liter of a polymer of polyacrylic acid and esters thereof and from about 0.2 to 8 grams per liter of an acid selected from the group $H_2ZrF_6$, $H_2TiF_6$ and $H_2SiF_6$. The pH of the solution is less than about 3.5.

A process for applying a protective coating to aluminum, zinc and iron under substantially identical operation conditions is disclosed in U.S. Pat. No. 3,682,713 to Ries, et al. The coating consists essentially of from 0.1 to 15 grams per liter of complex fluorides of boron, titanium, zirconium and iron, from 0.1 to 10 grams per liter of free fluoride ions and from 0.5 to 30 grams per liter an oxidizing agent such as sodium m-nitrobenzene sulfonate. The solution has a pH of from 3.0 to 6.8 and is free of phosphoric acid, oxalic acid and chromic acid.

The use of allyl ether copolymers in non-analogous arts such as dust control, dispersants and water treatment is known. Japanese patent publication SHO 56-155692 entitled Method of Collecting Dust discloses the use of acrylic acid/polyethylene glycol monoallyl ether copolymers to treat the recirculating water in an aqueous dust collection system. U.S. Pat. No. 4,500,693 which issued to Takehara et al., discloses the use of copolymers composed of a methacrylic acid and an allylic ether monomer which are useful as scale preventing agents in cooling water systems and wet dust collection systems, aqueous slurry dispersants in inorganic pigments, cement dispersants, and builders and detergents.

U.S. Pat. No. 4,471,100 which issued to Tsubakimoto et al., discloses a copolymer of maleic acid and polyethylene glycol ether and its use as a cement dispersant, pigment dispersant, chelating agent and scale inhibitor.

U.S. Pat. Nos. 4,872,995 and 4,913,882 to Chen et al., and U.S. Pat. Nos. 4,861,429 and 4,895,620 to Barnett et al., disclose methods and uses for acrylic acid/polyethylene glycol allyl ether copolymers in aqueous systems such as cooling water systems and paper making systems, as felt conditioners or to inhibit calcium oxalate deposition.

SUMMARY OF THE INVENTION

The present invention provides a method of treating the surface of galvanized steel to provide for the formation of a coating which increases the corrosion resistance and adhesion properties of the galvanized steel surface. The coating formed by the present invention may be dried in place or rinsed. The methods of the present invention comprise treating a galvanized steel surface with an aqueous treatment solution including a water soluble or water dispersible copolymer of maleic or acrylic acid and allyl ether or polymers of acrylic acid and homopolymers thereof alone or in combination with select acids.

The maleic or acrylic acid/allyl ether copolymers useful in accordance with the present invention have the structure Structure A

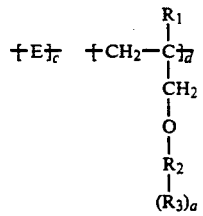

wherein E is the repeat unit remaining after polymerization of an alpha, beta ethylenically unsaturated compound, $R_1$ is H or lower ($C_1$-$C_4$) alkyl, $R_2$ is $-(CH_2-CH_2-O)_n-H$, $$-(CH_2-\underset{\underset{CH_3}{|}}{CH}-O)_n-H,$$

monohydroxylated $C_1$-$C_8$ alkyl, monohydroxylated $C_1$-$C_8$ alkylene, di-or polyhydroxy $C_1$-$C_8$ alkyl, dihydroxy or polyhydroxy $C_1$-$C_8$ alkylene, $C_1$-$C_8$ alkyl or $C_1$-$C_8$ alkylene, n is an integer of from 1 to about 20, a is 0 or 1, $R_3$ is hydrogen or an acetate formed by reacting an acetylating agent with an allyl ether, the molar ratio of repeat units c:d being from about 15:1 to about 1:10. The use of the above copolymers has been effective as a galvanized steel coating either alone or when used in combination with an acid selected from the group acetic acid, glycolic acid, dihydrohexafluotitanic acid, dihydrohexafluorzirconic acid and fluoboric acid.

The maleic or acrylic acid/allyl ether water soluble or water dispersible copolymers used in accordance with the present invention are known. As discussed above, their known uses include the inhibition of calcium oxalate deposition, as dispersants in water systems and as an antifreeze component. However, use of the described copolymers as galvanized steel coating agents to improve corrosion resistance and adhesion of later applied coatings is believed to be new.

While the compositions of the present invention have been disclosed for use in the pretreatment of aluminum, utilization of the preferred methods, i.e., concentrations, for aluminum lead to unacceptable adhesion of applied paints on galvanized steel. The present inventors discovered that using solution concentrations lower than optimum for aluminum to provide a lower specific coating weight gave, unexpectedly, acceptable performance on galvanized steel.

DETAILED DESCRIPTION OF THE PREFERRED EMBODIMENTS

The present inventors have discovered that an improved coating on articles of galvanized steel can be formed by a relatively dilute aqueous coating solution comprising a maleic or acrylic acid/allyl ether copolymer or acrylic acid polymer alone or in combination with a select acid. The combination was found to provide an aqueous pretreatment agent for the treatment of galvanized steel which provides improved corrosion resistance and adhesion of later applied coatings when the treatment is dried in place. The treatment of the present invention can optionally be rinsed after application as by a water bath or shower.

The preferred coating weight for the conversion coating on galvanized steel is from about 0.1 up to less than 1.4 milligrams per square foot based on zirconium or titanium. This relatively low coating weight is in contrast to preferred coating weights for aluminum which can be up to 3.4 milligrams per square foot based on zirconium or titanium.

Useful acrylic acid polymers within the scope of the present invention include water soluble as well as water dispersible polymers. Preferably, the polymer is a homopolymer of acrylic acid. When the polymer is polyacrylic acid, the molecular weight is preferably about 50,000.

The water soluble or water dispersible maleic or acrylic acid/allyl ether copolymers of the present invention comprise repeat units composed of an alpha, beta ethylenically unsaturated compound and an allyl alkylene ether based compound. The maleic or acrylic acid/allyl ether copolymers useful in accordance with the present invention have the general structure Formula I

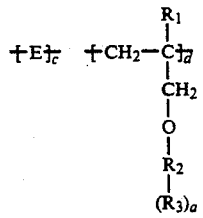

wherein E is the repeat unit remaining after polymerization of an alpha, beta ethylenically unsaturated compound, $R_1$ is H or lower ($C_1$-$C_4$) alkyl, $R_2$ is $-(CH_2-CH_2-O)_n-H$, $$-(CH_2-\underset{\underset{CH_3}{|}}{CH}-O)_n-H,$$

monohydroxylated $C_1$-$C_8$ alkyl, monohydroxylated $C_1$-$C_8$ alkylene, di- or polyhydroxy $C_1$-$C_8$ alkyl, dihydroxy or polyhydroxy $C_1$-$C_8$ alkylene, $C_1$-$C_8$ alkyl or $C_1$-$C_8$ alkylene, n is an integer of of from about I to about 20, a is 0 or 1, $R_3$ is hydrogen or an acetate formed as a cap on the polyethyleneglycol allyl ether by reacting an acetylating agent with an allyl ether of polyethylene glycol to produce an acetate capped polyethylene glycol monoallyl ether which is then reacted with the alpha, beta ethylenically unsaturated compound E to form the copolymer of Formula I. Suitable acetylating agents include acetic acid, acetic anhydride, acetyl chloride, and the like as described in U.S. Pat. Nos. 4,959,156 and 4,847,410 fully incorporated herein by reference. The molar ratio of repeat unit c:d can range from about 15:1 to about 1:10.

A preferred copolymer of the present invention includes acrylic acid or maleic acid/polyethylene glycol allyl ether copolymers of the general structure Formula II

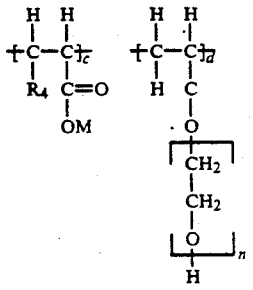

wherein $R_4$ is H or COOM, and M is H or a water soluble cation, n is from about I to about 20, preferably 1 to 15, c:d is from about 15:1 to about 1:10. Acrylic acid ($R_4$ equals H) may be replaced with maleic acid ($R_4$=COOH) in Formula II.

Another preferred copolymer is an acrylic acid or maleic acid/I allyloxy-2-propanol of the general formula

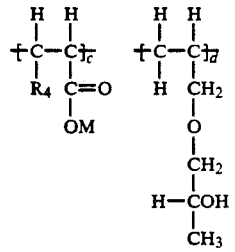

Formula III wherein $R_4$ and M as defined in Formula II and the molar ratio of c:d is from about 15:1 to about 1:10.

E of Formula I may, for an instance, comprise the repeat unit obtained after polymerization of an alpha, beta ethylenically unsaturated monomer, preferably a carboxylic acid, amide form thereof, or lower alkyl ($C_1$–$C_6$) ester or hydroxylated lower alkyl ($C_1$–$C_5$) ester of such carboxylic acids. Exemplary compounds encompassed by E include, but are not restricted to, the repeat unit formed by polymerization of acrylic acid, acrylamide, maleic acid or anhydride, fumaric acid, itaconic acid, 2-hydroxypropyl acrylate, styrene sulfonic acid, and 2-acrylamido-2-methylpropanesulfonic acid and the like. Water soluble salt forms of these acids are also within the purview of the invention.

The molar ratio c:d of the repeat units may fall within the range of about 30:1 to about 1:20, or desirably within the range of about 15:1 to about 1:10.

The number average molecular weight of the water soluble or water dispersible copolymers of Formulas I, II or III is not critical and may fall within the Mn range of about 1,000 to 10,000, desirably, 1,000 to 30,000 and more desirably 1,500 to 25,000. The key criterion is that the copolymer be water soluble or water dispersible. Water soluble or water dispersible terpolymers comprising monomer c and d of Formula I may also be effective for use in the present invention. Also, minor amounts of additional monomers may be added to the polymers.

The references discussed above disclose pretreatment of aluminum with solutions which are also useful in the present invention. However, these references set forth preferred concentration ranges that result in gravimetric coating weights of greater than 13 milligrams per square foot and 20 to 25 milligrams per square foot.

On galvanized steel, coating weights are much more highly dependent on the nature of the surface to be pretreated than is the case for aluminum. When a dried-in-place coating is formed, the substrate's elements and oxides are incorporated into the coating layer. Since the amount of metal oxide and its reactivity can vary from substrate to substrate, the values of gravimetric coating weights will also vary even for a single concentration of pretreatment. Direct comparisons of gravimetric coating weights between galvanized steel and aluminum do not directly compare quantities of pretreatment.

A more easily compared method of measuring pretreatments is to measure the quantity of transition metal on the surface that is derived from the pretreatment. This may be accomplished by a variety of techniques, including analysis of acidic stripping solutions for zirconium and/or titanium, and x-ray fluorescence methods. It was found that the proportion of zirconium or titanium in coatings on aluminum treated by the above pretreatment solutions was about 10 to 15% of the gravimetric coating weight.

Expressed in these terms, the preferred coating weight range for aluminum is from about 1.4 to 3.4 milligrams per square foot of zirconium or titanium. In contrast, it was discovered that the preferred coating weight range for galvanized steel is from about 0.1 to less than 1.4 milligrams per square foot of zirconium or titanium. It was discovered that for galvanized steel, as coating weight increased toward the disclosed ranges for aluminum the adhesion of an applied paint decreased. The preferred coating weight will vary somewhat with the type of paint which will be applied.

It was also discovered that when dihydrofluosilicic acid was substituted for dihydrofluozirconic acid in the treatment of galvanized steel, adhesion performance was similar but there were total failures in neutral salt fog tests. This contrasts with aluminum pretreatment where the usefulness of dihydrofluosilicic acid based pretreatments is known.

The method of pretreating galvanized steel of the present invention entails the application of the chromium free acidic solution of the above copolymers to a galvanized steel surface. Preferably, the solution is dried in place on the surface of the metal to provide the desired coating weight of from about 0.1 to less than 1.4 milligrams per square foot based on zirconium or titanium. The application may be by any of several techniques familiar to those skilled in the art, such as roll coating, dip/squeegee, spray and the like. The copolymer in the treatment solution is preferably in the concentration range of from about 0.06 to 2.5 grams per liter of solution and the acid present in the concentration range of from about 0.3 to 3 grams per liter of solution. The pH of the treatment solution is preferably below about pH 5. The presently preferred solution is the copolymer represented by Formula II where $R_4$ is H (i.e. acrylic acid), M=H or Na, c:d=3:1, and n=10.

The pretreatment solution of the present invention in practice may be formed from individual copolymer and acid components or preferably, may be supplied as a homogeneous copolymer/acid aqueous concentrate.

The present invention will now be further described with reference to a number of specific examples which are to be regarded solely as illustrative and not as restricting the scope of the present invention. In these examples, the effectiveness was evaluated with a variety of paint adhesion tests familiar to those skilled in the art. These tests include: "T-Bend" the tendency for paint to disadhere from a 180° bend in the metal (OT equals perfect); "Wedge Bend": the amount of paint (in millimeters) lost from the surface above the minimum radius of curvature of a bend in the metal. The bend is formed by first turning the painted metal through a radius of about 0.5 centimeters and then flattening an end of the bend to a zero radius; "Reverse Impact": tendency of paint to disadhere from deformed metal caused by an impact of known momentum on the reverse side of the test surface. This test may be done on dry test panels or panels subjected to boiling water prior to impact (10=perfect rating, noted in inch-pound impact); "Cross-Hatch/Reverse Impact": the tendency of paint to disadhere from areas between closely spaced lines through the paint scribed prior to reverse impact, the test may be done dry or following boiling water treatment (10=perfect rating); "Neutral Salt Spray": per ASTM-B-117 and rated according to ASTM D-1654, section 7, method 2.

In the following examples copolymers of acrylic acid (AA) with polyethyleneglycol allyl ether (PEGAE) or I-allyloxy-2-propanol (AOP) were prepared in substantial conformity to the procedures described in Examples 7 through 10 of U.S. Pat. No. 4,872,995 incorporated herein by reference. The major exception was the relative ratios of reactants used and the molecular weight of the resulting polymers. Maleic acid (MA)/polyethylene glycol allyl ether copolymers were prepared in substantial conformity to the procedures described in U.S. Pat. No. 4,471,100 incorporated herein by reference. The following Table summarizes the physical properties of the copolymers employed in the examples.

| Copolymer Properties | | | | | |
|---|---|---|---|---|---|
| Copolymer # | Composition | Mole Ratio | Brookfield Viscosity cps, 25° C. | % Solids | pH |
| 1 | AA/PEGAE* | 3:1 | 32.6 | 25.3 | 5.8 |
| 2 | AA/PEGAE** | 3:1 | 23.0 | 24.2 | 6.1 |
| 3 | AA/AOP | 3:1 | 15.1 | 24.8 | 5.7 |
| 4 | MA/PEGAE* | 1:1 | 237.0 | 49.2 | 9.5 |
| 5 | MA/PEGAE** | 1.5:1 | 34.6 | 39.9 | 9.1 |

*4 moles of ethylene glycol
**9-10 moles of ethylene glycol

Test panels for the examples were prepared as follows: hot dipped galvanized steel test panels manufactured by ACT Corporation were spray cleaned with a 2% aqueous solution of an alkaline surfactant product (Betz Kleen® 4000 available from Betz Laboratories, Inc., Trevose, PA). The panels were rinsed in tap water, passed through squeegee rolls to remove most of the rinse water, and then spin coated by flooding one surface of the panel with the test solution and spinning for about 10 seconds. The panels were then dried on the spinner without rinsing using a stream of warm air.

Gravimetric coating weights were determined by immersing a measured weighed sample of a spin coated test panel in a solution of 1% ammonium dichromate dissolved in concentrated ammonium hydroxide for four minutes. During the immersion, the coated side of the panel was scrubbed with a rubber spatula. The panel was subsequently rinsed, dried, and reweighed. A correction for the uncoated side was applied by deducting ½ of the weight change for a blank (untreated) panel. Weights were converted to milligrams per square foot using the known treated surface area.

Table 1 summarizes the makeup of the treatment solutions and gravimetric coating weights.

TABLE 1

| Pre-treatment Solution | g/l as H2ZrF6 | g/l as H2TiF6 | g/l as Poly-(acrylic acid) | g/l acrylic acid PEG allyl ether | Gravimetric Coating Weight (mg/ft2) |
|---|---|---|---|---|---|
| A | 0.6 | <0.1 | 0.5 | 0 | 21 |
| B | 2.9 | <0.1 | 2.5 | 0 | 23 |
| C | 5.7 | 0.1 | 5.0 | 0 | 25 |
| D | 11.4 | 0.2 | 10.0 | 0 | 44 |
| E | 0 | 0.6 | 0.5 | 0 | 13 |
| F | 0 | 2.9 | 2.5 | 0 | 20 |
| G | 0 | 5.8 | 5.0 | 0 | 32 |
| H | 0 | 11.6 | 10.0 | 0 | 27 |
| I | 0.15 | 0 | 0 | 0.03 | —* |
| J | 0.15 | 0 | 0.13 | 0 | —* |
| K | 0.15 | 0 | 0.13 | 0.75 | —* |
| L | 0 | 0.15 | 0 | 0.03 | —* |
| M | 0 | 0.15 | 0.13 | 0 | 0 |
| N | 1.14 | 0 | 0 | 0.26 | 16 |
| O | 1.14 | 0 | 0 | 1.01 | 11 |
| P | 1.14 | 0 | 0 | 1.76 | 14 |
| Q | 1.14 | 0 | 1.0 | 0 | 10 |

*not measured

EXAMPLE 1

A 1% dilution of a solution containing 0.20 g/l as fluozirconic acid and 0.18 g/l as poly(acrylic acid) was applied to both hot-dipped galvanized steel and 3003 alloy aluminum, following the method described above.

The dried-in-place coatings were removed from the test panels using 1 N sulfuric acid for galvanized steel and 50% v/v of concentrated nitric acid for aluminum. The acidic stripping solutions were analyzed for Zr by Inductively Coupled Plasma Emission Spectroscopy, and the coating weights were calculated using the known surface area that was treated. The following was obtained:

Aluminum: 0.14 mg/ft$^2$ as Zr

Galvanized Steel: 0.62 mg/ft$^2$ as Zr

The gravimetric coating weight for aluminum was 1.8 mg/ft$^2$. This coating weight is much too low to provide effective pretreatment of aluminum. Surprisingly, the Zr coating weight on galvanized steel is over four times larger.

EXAMPLE 2

A two-coat paint system was applied to test panels treated with treatment solution A-H. The two-coat system comprised an epoxy primer applied by draw down bar and baked to a peak metal temperature in accordance with the manufacturer's specifications, giving a 0.25 mil dry film thickness. Adhesion testing of the primer alone was measured. The results are summarized in Table 2.

Thereafter, a fluorocarbon topcoat was applied to primered test panel to provide a film thickness of 0.85 mils and neutral salt spray corrosion resistance tests in accordance with ASTM-D-1654 were performed. Table 3 summarizes the results.

TABLE 2

| Pretreatment Solution | T-Bends (pass) | Wedge Bend Loss (mm) | Cross Hatch + Reverse Impact Rating |
|---|---|---|---|
| A | 3 | 39 | 10 |
| B | 5 | 65 | 8 |
| C | >6 | 82 | 2 |
| D | >6 | 91 | 0 |
| E | 2 | 24 | 10 |
| F | >5 | 87 | 4 |
| G | >5 | 93 | 2 |
| H | >5 | 94 | 0 |

TABLE 3

| Pretreatment Solution | 500 hour Neutral Salt Spray Scribe Ratings | Field Ratings |
|---|---|---|
| A | 5, 6.5 | 10, 10 |
| B | 4.5, 6 | 10, 10 |
| C | 5.5, 5 | 10, 10 |
| D | 6 5.5 | 10, 10 |
| E | 5, 5 | 10, 10 |
| F | 4, 4 | 10, 10 |
| G | 5, 5.5 | 10, 10 |
| H | 6, 5.5 | 10, 10 |

As can be seen from Table 2, the adhesion performance of the primer coat declined markedly for the more concentrated pretreatment solutions (which result in higher gravimetric coating weights). An approximate upper boundary, based on gravimetric coating weight is about 20 milligrams per square foot. This equates to a coating weight of about 1.4 mg/ft$^2$ based on zirconium or titanium.

EXAMPLE 3

Test panels were prepared as described above. The type and concentration of polymer was varied in the treatment solution as shown in Table 4. The paint system was a two-coat paint system comprising an epoxy primer applied by draw-down bar and baked to a peak metal temperature in accordance with the manufacturers specifications giving a 0.25 mil dry film thickness followed by a fluocarbon topcoat having a dry film thickness of 0.85 mils. Table 4 summarizes the results.

TABLE 4

| Pre-treatment Solution | T-Bends (pass) | Wedge Bend Loss (mm) | Cross Hatch + Reverse Impact Rating | 500 hr Neutral Salt Spray Rating Scribe | Field |
|---|---|---|---|---|---|
| I | 2 | 15 | 10 | 6.5, 5 | 8, 8 |
| J | 2 | 20 | 10 | 5, 4 | 10, 10 |
| K | >2 | 22 | 10 | 3.5, 3.5 | 10, 10 |
| L | 3 | 30 | 10 | 4, 4 | 10, 10 |
| M | 2 | 17 | 10 | 3.5, 4 | 10, 10 |

EXAMPLE 4

Tests panels were prepared as described above. The varied polymers of Example 2 were employed in the pretreatment solution. An epoxy primer and a siliconized polyester topcoat paint system was applied. Table 5 summarizes the adhesion test results.

TABLE 5

| Pre-treatment Solution | T-Bends (pass) | Wedge Bend Loss (mm) | Cross Hatch + Reverse Impact Rating | 600 hr Neutral Salt Spray Rating Scribe | Field |
|---|---|---|---|---|---|
| I | 3 | 22 | 8 | 6, 5 | 8, 8 |
| J | 2 | 23 | 9 | 6, 7 | 7, 7 |
| K | >3 | 24 | 10 | 6, 6 | 7, 7 |
| L | >3 | 29 | 0 | 3, 4 | 6, 7 |
| M | >3 | 15 | 1 | 5, 5 | 9, 9 |

EXAMPLE 5

The process of example 2 was followed with the substitution of the polymers shown listed in Table 6 and a fluorocarbon based paint for the topcoat. Table 6 summarizes the adhesion test results.

TABLE 6

| Pre-treatment Solution | T-Bends (pass) | Wedge Bend Loss (mm) | Cross Hatch + Reverse Impact Rating | 500 hr Neutral Salt Spray Rating Scribe | Field |
|---|---|---|---|---|---|
| N | >3 | 15 | 8 | 5 | 10 |
| O | 3 | 14 | 9 | 1 | 10 |
| P | >2 | 10 | 10 | 2 | 10 |
| Q | 2 | 7 | 9 | 1 | 10 |

EXAMPLE 6

The process of example 2 was followed however the substrate was an electrogalvanized steel from a conduit manufacturer. Table 7 summarizes the adhesion and salt spray test results.

TABLE 7

| Pre-treatment Solution | T-Bends (pass) | Wedge Bend Loss (mm) | Cross Hatch + Reverse Impact Rating | 500 hr Neutral Salt Spray Rating Scribe | Field |
|---|---|---|---|---|---|
| N | 3 | 12 | 10 | 6, 6.5 | 10, 10 |
| 25% dilution-of N | 4 | 31 | 10 | 6, 6.5 | 10, 10 |

EXAMPLE 7

Test panels prepared as described in example 3 and 5 were treated with the treatment solutions shown in Table 8. Table 8 summarizes the adhesion and salt spray test results.

TABLE 8

| Pretreatment Solution | T-Bend | Wedge Bend | XH+ RI | QCT (240 hr) | 500 hr Neutral Salt Spray Rating Scribe | Field |
|---|---|---|---|---|---|---|
| 10% (0.2% act. H2TiF6 + .041% NiCO3; DI rinse) | 4T | 26 | 8 | 9, 7 | 3, 5 | 9, 10 |
| 0.2% (act) H2TiF6 (DI rinse) | >4T | 32 | 10 | 10, 10 | 5, 5 | 9, 10 |
| 2% (0.11% act. H2ZrF6 + 0.1% act. PAA; | 3T | 10 | 10 | 10, 10 | 4, 5 | 6, 5 |

TABLE 8-continued

| Pretreatment Solution | T-Bend | Wedge Bend | XH+ RI | QCT (240 hr) | 500 hr Neutral Salt Spray Rating Scribe | Field |
|---|---|---|---|---|---|---|
| no rinse) | | | | | | |

As shown in Table 8, the deletion of nickel from a known treatment solution (taught in PCT patent publication WO 85/105181) had an adverse effect on T-bend, wedge bend and cross-hatch plus reverse impact (XH +RI) adhesion tests. The treatment solutions of the present invention out-performed both. The neutral salt spray (NSS) scribe ratings for the prior art were also inferior to the present invention. Field ratings favored the rinsed processes.

EXAMPLE 8

The process of Example 2 was followed with the substitution of dihydroflurosilicic acid for dihydrofluorozirconic acid in pretreatment solution A. Although adhesion performance was similar, there were total failures in the salt spray tests.

EXAMPLE 9

Test panels were prepared as in Example 5 with the pretreatment solutions shown in Table 9. A different fluorocarbon topcoat than used in Example 5 was applied. Pretreatment solution S and U have fluoboric acid substituted for fluozirconic acid at the same normal concentration as in solutions V and W. Pretreatment solution V and W gave 1.6 and 1.4 mg/ft$^2$ of zirconium respectively on the galvanized steel. Table 10 summarizes the results.

TABLE 9

| Pre-treatment Solution | g/l as H2ZrF6 | g/l as HBF4 | g/l as Poly-(acrylic acid) | g/l acrylic acid PEG allyl ether | Gravimetric Coating Weight (mg/ft2) |
|---|---|---|---|---|---|
| R | 0 | 0.88 | 0.88 | 0 | * |
| S | 0 | 2.63 | 2.63 | 0 | * |
| T | 0 | 0.88 | 0 | 0.21 | * |
| U | 0 | 2.63 | 0 | 0.66 | * |
| V | 3.0 | 0 | 2.63 | 0 | 18 |
| W | 3.0 | 0 | 0 | 0.66 | 16 |

*not measured

TABLE 10

| Pre-treatment Solution | T-Bends (pass) | Wedge Bend Loss (mm) | Cross Hatch + Reverse Impact Rating | QCT Rating (240 hr) | 500 hr Neutral Salt Spray Rating Scribe | Field |
|---|---|---|---|---|---|---|
| R | 2 | 0 | 10 | 10, 8 | 4.5, 5.5 | 7, 8 |
| S | 2 | 0 | 10 | 8, 10 | 4.5, 4.5 | 8, 10 |
| T | 1 | 0 | 10 | 10, 10 | 3, 4 | 10, 8 |
| U | 1 | 0 | 10 | 10, 10 | 4, 5 | 8, 8 |
| V | 0 | 0 | 10 | 10, 10 | 4.5, 5 | 10, 8 |
| W | 0 | 0 | 10 | 10, 10 | 5.5, 5.5 | 8, 9 |

The Examples show the efficacy of the treatment of the present invention on galvanized steel. The tables also show that for galvanized steel, lower gravimetric coating weights than are used on aluminum are required and that while adhesion may benefit as the polymer concentration is raised, the increase may have an adverse affect on salt spray performance.

It should be understood that the foregoing description of this invention is not intended to be limiting, but is only exemplary of the inventive features which are defined in the claims.

What is claimed is:

1. A method of forming a dried in place conversion coating on a galvanized steel surface comprising: reacting the galvanized steel surface with an aqueous solution of water soluble or water dispersible polymer selected from the group comprising polyacrylic acid and homopolymers thereof and copolymers having repeat units represented by the formula

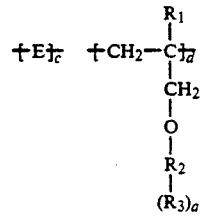

wherein E is the repeat unit remaining after polymerization of an alpha, beta ethylenically unsaturated compound, $R_1$ is H or lower ($C_1$-$C_4$) alkyl, $R_2$ is $\text{-}(CH_2\text{—}CH_2\text{—}O)_n\text{-}H$,

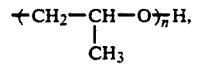

monohydroxylated $C_1$-$C_8$ alkyl, monohydroxylated $C_1$-$C_8$ alkylene, di- or polyhydroxy $C_1$-$C_8$ alkylene, n is an integer of from about 1 to about 20, a is 0 or 1, $R_3$ is hydrogen or an acetate form by reacting an acetylating agent with an allyl ether, the molar ratio of repeat units c:d is from about 15:1 to about 1:10; and optionally an acid selected from the group consisting of acetic acid, glycolic acid, dihydrohexafluotitanic acid, dihydrohexafluozirconic acid, fluoboric acid, and combinations thereof.

2. The method of claim I wherein said water soluble or water dispersible copolymer has a molecular weight (Mn) of from about 1000 to 100,000.

3. The method of claim I wherein said water soluble or water dispersible copolymer has a molecular weight (Mn) of from about 1000 to about 30,000.

4. A method of claim 3 wherein said water soluble or water dispersible copolymer has a molecular weight (Mn) of from about 2,500 to 25,000.

5. The method of claim 1 wherein E is the repeat unit obtained from polymerization of acrylic or maleic acid.

6. The method of claim 1 wherein $R_1$ is H, $R_2$ is 2-hydroxypropyl, and a=0.

7. The method of claim 1 wherein $R_1$ is H, $R_2$ is $\text{-}(CH_2\text{—}CH_2\text{—}O)_n\text{H}$, a=0 and n is about 1 to 15.

8. The method of claim 1 wherein $R_2$ is $$\text{-}(CH_2\text{—}\underset{\underset{CH_3}{|}}{CH}\text{—}O)_n\text{H},$$

$R_1$ is H, n is about 1 to 15 and a=0.

9. The method of claim 1 wherein the pH of said aqueous solution is from about 1.5 to 5.0.

10. The method of claim 1 wherein said aqueous solution is dried in place.

11. The method of claim 1 wherein said aqueous solution is rinsed off with water after reacting for sufficient time to provide a coating weight of from about 0.1 to less than 1.4 grams per square foot zirconium or titanium.

12. A method of forming a dried in place conversion coating on an galvanized steel surface comprising: reacting the galvanized steel with an aqueous solution of water soluble or water dispersible polymer having repeat units represented by the formula $$\text{-}(E)_c\text{-}\ \text{-}(CH_2\text{—}\underset{\underset{\underset{\underset{\underset{(R_3)_a}{|}}{R_2}}{|}}{\underset{\underset{CH_2}{|}}{\underset{\underset{O}{|}}{\underset{|}{C}}}}}{R_1})_d\text{-}$$

wherein E is the repeat unit remaining after polymerization of an alpha, beta ethylenically unsaturated compound, $R_1$ is H or lower (C1-C4) alkyl, $R_2$ is $\text{-}(CH_2\text{—}CH_2\text{—}O)_n\text{H}$, $$\text{-}(CH_2\text{—}\underset{\underset{CH_3}{|}}{CH}\text{—}O)_n\text{H},$$

monohydroxylated C1-C8 alkyl, monohydroxylated C1-C8 alkylene, di-or polyhydroxy C1-C8 alkylene, n is an integer of from 1 to about 20, a is 0 or 1, $R_3$ is hydrogen or an acetate formed by reacting an acetylating agent with an allyl ether, the molar ratio of repeat units c:d is from about 15:1 to about 1:10; and optionally an acid selected from the group consisting of acetic acid, glycolic acid, dihydrohexafluotitanic acid, dihydrohexafluozirconic acid, fluoboric acid, and combinations thereof; and drying said aqueous solution in place.

13. The method of claim 12 wherein E is the repeat unit obtained from the polymerization of acrylic or maleic acid.

14. The method of claim 12 wherein $R_2$ is H, $R_2$ is $\text{-}(CH_2\text{—}CH_2\text{—}O)_n\text{H}$, a=0, and n is about 1 to 15.

15. The method of claim 12 wherein $R_1$ is H, $R_2$ is $\text{-}(CH_2\text{—}CH_2\text{—}O)_n\text{H}$, a=0, and n is about 1 to 15.

16. The method of claim 12 wherein $R_2$ is $$\text{-}(CH_2\text{—}\underset{\underset{CH_3}{|}}{CH}\text{—}O)_n\text{H},$$

$R_1$ is H, n is about 1 to 15 and a=0.

* * * * *